US007485191B2

(12) United States Patent
Axtell et al.

(10) Patent No.: US 7,485,191 B2
(45) Date of Patent: Feb. 3, 2009

(54) NOZZLE TIP AND METHODS OF USE

(75) Inventors: Douglas H. Axtell, Rochester, NY (US); John P. Macauley, Henrietta, NY (US); Charles M. Rankin, Jr., Penfield, NY (US); Megan L. Weiner, Rochester, NY (US)

(73) Assignee: Industrial Technology Research Institute (TW)

( * ) Notice: Subject to any disclaimer, the term of this patent is extended or adjusted under 35 U.S.C. 154(b) by 584 days.

(21) Appl. No.: 10/851,560

(22) Filed: May 21, 2004

(65) Prior Publication Data

US 2005/0257811 A1 Nov. 24, 2005

(51) Int. Cl.
*B08B 3/00* (2006.01)

(52) U.S. Cl. ..... 134/34

(58) Field of Classification Search ..... 134/34
See application file for complete search history.

(56) References Cited

U.S. PATENT DOCUMENTS

| | | | | |
|---|---|---|---|---|
| 4,863,610 | A * | 9/1989 | Campbell | 210/658 |
| 5,506,668 | A | 4/1996 | Guth | |
| 5,532,810 | A | 7/1996 | Cahill | |
| 5,589,925 | A | 12/1996 | Cahill | |
| 5,659,865 | A | 8/1997 | Zarbo | |
| 5,670,202 | A | 9/1997 | Guzowski et al. | |
| 5,893,012 | A | 4/1999 | Schubert et al. | |
| 5,905,932 | A | 5/1999 | Morse et al. | |
| 6,029,039 | A | 2/2000 | Aslam et al. | |
| 6,136,141 | A | 10/2000 | Glatfelter et al. | |
| 6,208,827 | B1 | 3/2001 | Aslam et al. | |
| 6,469,757 | B1 | 10/2002 | Petruchik | |
| 6,470,782 | B1 | 10/2002 | Shimotoyodome et al. | |
| 6,524,681 | B1 * | 2/2003 | Seitz et al. | 428/143 |
| 6,564,030 | B2 | 5/2003 | Baughman et al. | |
| D478,383 | S | 8/2003 | Timm et al. | |
| 6,678,496 | B1 | 1/2004 | Aslam et al. | |
| 7,024,153 | B2 | 4/2006 | Weiner et al. | |
| 2003/0168319 | A1 * | 9/2003 | Hart et al. | 198/781.04 |

* cited by examiner

*Primary Examiner*—Frankie L Stinson
*Assistant Examiner*—Samuel A Waldbaum
(74) *Attorney, Agent, or Firm*—Alston & Bird LLP

(57) ABSTRACT

A nozzle tip having two faces and methods of using the nozzle tip are described. The nozzle tip has a proximal end, a distal end, and a longitudinal axis extending from the proximal end to the distal end. The proximal end has an opening defined by a first face including a first edge, and a second face including a second edge, wherein the first face is at an angle of from about 20 degrees to about 120 degrees relative to the axis, and the second face is at an angle of from about 15 degrees to about 70 degrees relative to the axis. The nozzle tip can be incorporated into a device or assembly for skiving.

25 Claims, 8 Drawing Sheets

NOZZLE TIP AND METHODS OF USE

CROSS REFERENCE TO RELATED APPLICATIONS

Cross-reference is made to related, co-filed application Ser. No. 10/851,451 to Axtell et al., co-filed applications Ser. Nos. 10/851,492 and 10/851,590 to Weiner et al., and co-filed applications Ser. Nos. 11/851,913 and 10/851,439 to Rankin et al.

FIELD OF THE INVENTION

A nozzle tip, assembly including the nozzle tip, and methods for selectively removing material using the nozzle tip and assembly are presented.

BACKGROUND OF THE INVENTION

Often in manufacturing processes, a material, or a portion of a material needs to be removed before further processing steps can occur. Such material removal can be referred to as "skiving." Various methods of skiving or material removal are known in manufacturing processes.

U.S. Pat. No. 6,678,496 discloses a mechanism for skiving fuser rollers using skive assemblies including elongated, thin, flexible members that scrape material from the fuser apparatus roller. An air plenum with a nozzle arrangement provides positive airflow to ensure that the fuser apparatus roller is fully stripped. The skiving assembly as described in this patent scrapes the material away, and any remaining material is removed by airflow from the nozzle.

It has been shown in U.S. Pat. Nos. 5,532,810; 5,589,925; and 6,029,039 that elongated skive fingers of limited flexibility mounted in particularly configured support bodies substantially prevent damaging flex of the skive fingers. In these skive mechanisms, the support bodies support a major portion of the skive fingers and pivot into engagement with the fuser roller to limit skive finger flexing when engaged by a material to be skived, typically from a roller. The skive fingers can be retractable to prevent damage by jammed materials.

U.S. Pat. No. 5,670,202 discloses a technique for selectively applying materials in a pattern by spraying and then collecting the excess materials using adjustable skive manifolds on each side of the spray pattern, which function to vacuum off the edges of the airless spray pattern. The system utilizes a robot manipulator, a masking tool assembly, and other hardware, to recover material sprayed and skived by the masking tool assembly.

U.S. Pat. No. 6,564,030 discloses a fuser station with a vented skive assembly for an image-forming machine. The image-forming machine has a photoconductor, a primary charger, an exposure machine, a toning station, a transfer charger, and a vented fuser station. The fuser station may include a pressure roller, a fuser roller, and a skive assembly. The skive assembly has rib sections forming one or more slots, which are configured to provide an airflow pattern to reduce condensation.

U.S. Pat. No. 6,136,141 discloses fabrication of lightweight semiconductor devices including removal of a substrate from a support member utilizing a beam of radiant energy. The substrate is skived from the support member without damage to the semiconductor device. This method can be implemented on a continuous, roll-to-roll basis wherein the substrate and support member each comprise an elongated web, and wherein the webs are continuously advanced through a plurality of deposition chambers and the skiving area.

U.S. Pat. No. 6,469,757 discloses a technique for selectively removing a liquid crystalline material layer from a multi-layered substrate. The liquid crystalline material was coated and dried on the substrate, then a nozzle tip was used to remove the liquid crystalline material from the substrate, as it was moved on a rotating drum past the nozzle in a batch process. To remove all the desired material using this nozzle, multiple nozzle passes may be needed, prohibiting roll-to-roll processing. It has been found that harder materials, for example, cross-linked materials, cannot be skived with this process.

It would be advantageous to have a means of removing any amount of material, from a portion of a layer to more than one layer of material, in a batch or a roll-to-roll (continuous) manufacturing process. Further, a method and apparatus capable of removing materials of varying hardness, for example, solvents (including water), metal, gelatin, liquid crystal, polymers, ceramics and pulp, is desirable.

SUMMARY OF THE INVENTION

The present invention is directed to apparatuses and methods for removing materials in layers from a substrate. A nozzle tip having a proximal end, a distal end, and a longitudinal axis extending from the proximal end to the distal end, the proximal end having an opening defined by a first face and a second face, the first face being at an angle of from about 20 degrees to about 120 degrees relative to the axis, and the second face being at an angle of from about 15 degrees to about 75 degrees relative to the axis, can be used to remove materials from a substrate. The nozzle tip can be part of a device or assembly including one or more nozzle tips, and a means of positioning the nozzle tip relative to a substrate.

ADVANTAGES

A nozzle tip as described herein has a bi-facial opening suitable for skiving materials of all types, from soft coatings to hard materials such as metal, cross-linked polymers, or dried materials. The nozzle tip is capable of removing from a portion of a layer to more than one layer of material in a single pass. Skiving using the nozzle tip, or a device or apparatus including at least one nozzle tip, can be done in a batch or a roll-to-roll process. Single- or multiple-pass skiving can be done.

BRIEF DESCRIPTION OF THE DRAWINGS

The invention can be understood with reference to the detailed description below and the accompanying figures, as follows.

DETAILED DESCRIPTION OF THE INVENTION

The present invention provides methods and apparatuses useful for removing materials by the use of a nozzle tip during a manufacturing process. The method and apparatus can be useful in the manufacture of various materials, including, for example, graphic arts, metal working, paper molding, food processing, imaging and display materials, display devices, electronic devices, and other coated materials.

"Skiving" as used herein is the controlled removal of at least a portion of one or more layers of material from a substrate. As described herein, skiving can be done by a nozzle tip, wherein the nozzle tip penetrates one or more layers of the substrate and removes the penetrated material.

"Substrate" as used herein is one or more layers, which can be the same or different composition. The substrate can be skived to remove material therefrom.

"Material" as used herein refers to the portion of the substrate that is removed, or intended to be removed, by skiving.

Figure 1:
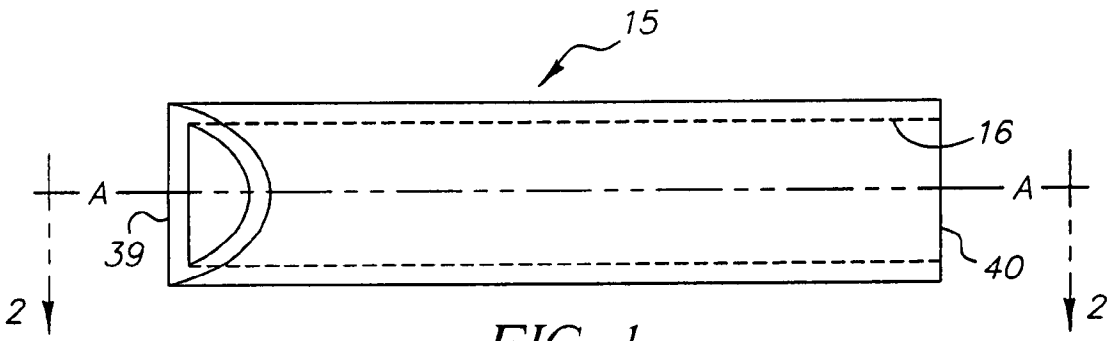
FIG. 1 is a view of a nozzle tip configuration of the invention.
Figure 2:
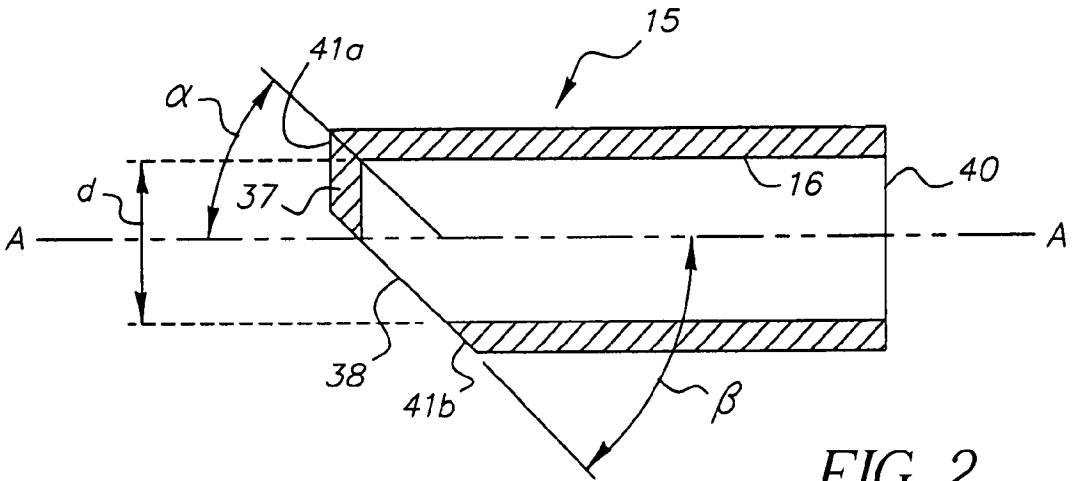
FIG. 2 is an enlarged cross-sectional view of the nozzle tip of FIG. 1 along section line A-A.

A nozzle tip useful for skiving is shown in FIGS. 1 and 2. The nozzle tip 15 can include a proximal end 39, and a distal end 40. An opening 16 extends along a longitudinal axis (line A-A) from the proximal end 39 to the distal end 40. As shown in FIG. 2, the proximal end 39 can have an opening defined by a first face 37 and a second face 38. The first face 37 can be at an angle $\alpha$ from 20 degrees to 120 degrees relative to the longitudinal axis A-A. The second face 38 can be at an angle $\beta$ from 15 degrees to 75 degrees relative to the longitudinal axis. According to certain embodiments, the angle $\alpha$ of the first face 37 is greater than the angle $\beta$ of the second face 38. The angles $\alpha$ and $\beta$ are measured from the longitudinal axis A-A to the outermost edge of the first face 37 or the second face 38, respectively, as shown in FIG. 2.

The first face edge 41*a*, the second face edge 41*b*, or both can be beveled to reduce the surface area of the cutting or skiving surface of the nozzle tip 15. Reducing the surface area of the nozzle tip 15 can aid in producing a cleaner cut through a substrate, and can reduce friction. According to certain embodiments, the edge of either the first face or the second face can be beveled toward the opening 16. This can aid in channeling skived material through the opening 16 in the nozzle tip 15 for disposal. The first face edge 41*a*, the second face edge 41*b*, or both, can form a parabolic shape. The shape of the first face edge 41*a* and the second face edge 41*b* can be the same or different. The first face 37 can have a height equal to or greater than the height of the material to be removed. According to certain embodiments, the height of the second face 38 can be equal to or greater than the height of the first face 37.

Figure 3:
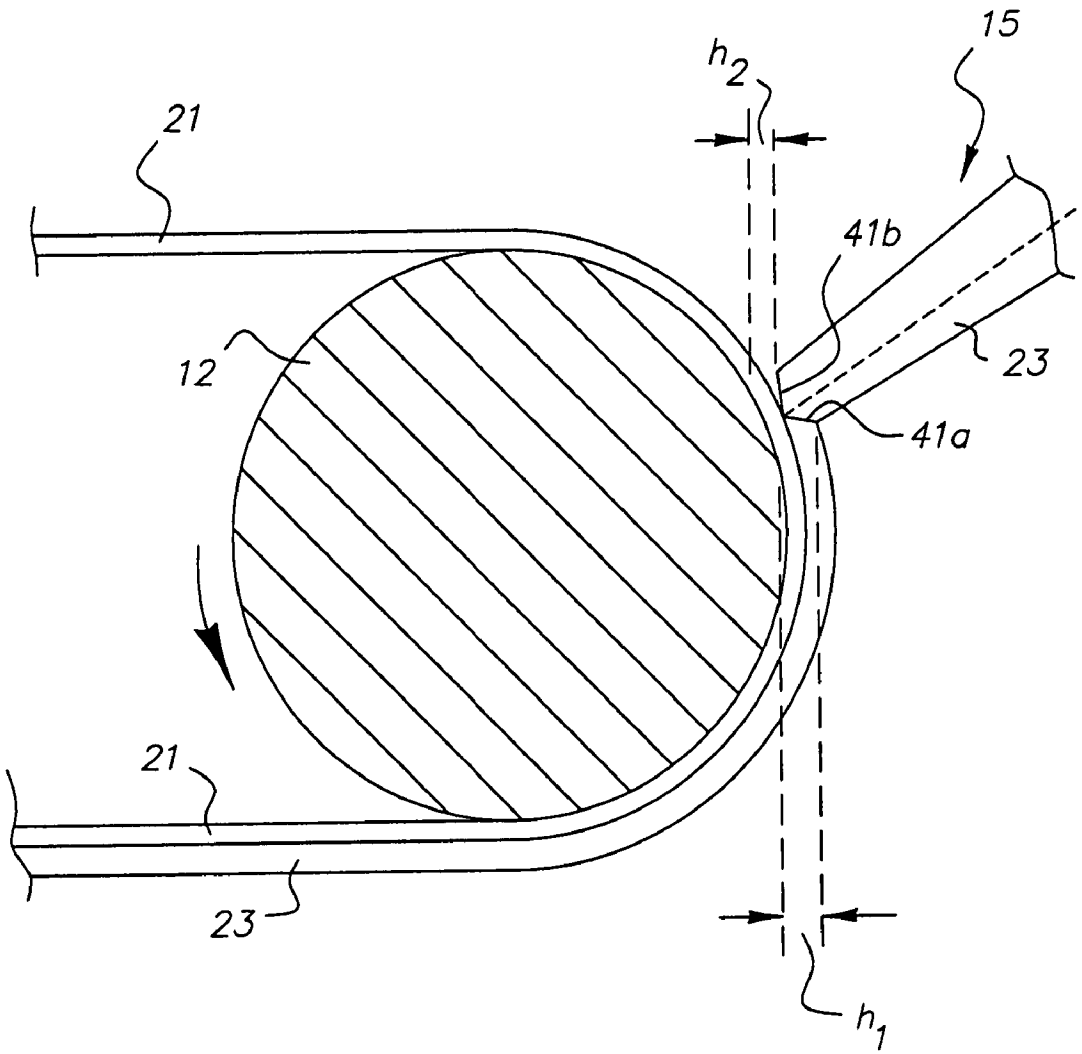
FIG. 3 is a cross-sectional view of a skiving assembly.

As shown in FIG. 3, in use, the first face edge 41*a* can be placed at a certain height $h_1$ from a support 12 to remove material 23 from the substrate 21 carried on support 12. The material 23 can include one or more compositions in one or more layers or portions of a layer. The area from which the material 23 has been removed is referred to as a chasm. The first face edge 41*a* can contact the material 23 before the second face edge 41*b*. The second face edge 41*b* of the nozzle tip 15 follows the first face edge 41*a* at a set height $h_2$ from the support 12. The second face edge 41*b* can be at the same height from the support 12 as the first face edge 41*a*, further from the support 12, or closer to the support 12, depending on the desired purpose of the second face edge 41*b*. If the second face edge 41*b* is at about the same height from the support 12 as the first face edge 41*a*, the second face edge 41*b* can remove any remaining material missed by the first face edge 41*a*, clean the edges of the chasm, or widen the chasm. If the second face edge 41*b* is further from the support 12 than the first face edge 41*a*, the second face edge 41*b* can remove material loosened by the first face edge 41*a*, and smooth or widen the upper edges of the chasm. If the second face edge 41*b* is closer to the support 12 than the first face edge 41*a*, the second face edge 41*b* can remove material missed by the first face edge 41*a*, remove an additional amount of material, and form the edges defining the chasm. The angle of intersection of the first face edge 41*a* and the second face edge 41*b* can be designed such that the nozzle tip does not gouge, scratch, or remove material below the desired height.

The profile of the chasm created by the nozzle tip in the material can be determined by the configuration of the first face edge 41*a*, the second face edge 41*b*, or a combination thereof. The depth of the chasm in the substrate can be determined by the height of the face edge closest to the support 12, that is, the lesser of $h_1$ or $h_2$, with respect to the total height of the substrate from the support. The width of the skive area is determined by the greatest diameter of the first face or the second face of the nozzle tip, wherein the diameter is measured as the widest point across a given face.

The opening at the proximal end of the nozzle tip can extend along the longitudinal axis of the nozzle tip from the proximal end to an exit port at the distal end, or to an exit port near the distal end of the nozzle tip. The opening can be circular, ovoid, elliptical, square, rectangular, polygonal, or any other suitable shape. According to certain embodiments, the opening can be circular or ovoid. The opening can change shape as it progresses from the proximal end to the distal end of the nozzle tip. The opening can maintain a constant diameter from the proximal end to the exit port, or the diameter can vary at any point along the length of the opening. As used herein, the diameter of the opening is defined as the longest distance d along a perpendicular line from the interior of the first face edge 41*a* to the interior of the second face edge 41*b*, as shown in FIG. 2. According to certain embodiments, the diameter of the opening can widen or narrow as it nears the exit port, forming a conical opening. The diameter of the opening can widen as it nears the exit port or distal end. The opening can change diameter at some point between the proximal end and the distal end from a first constant diameter to a second constant diameter, with or without a gradual change between diameters. The nozzle tip opening at the proximal end can have a diameter of from 0.1 to 50 millimeters, for example, 0.1 to 20 millimeters, 1 to 8 millimeters, or 1.5 to 5 millimeters. Depending on the intended use of the nozzle tip, the diameter of the opening at the proximal end can be larger than 50 millimeters, or less than 0.1 millimeters.

The nozzle tip can be made of a material that is machinable, forgeable, moldable, or a combination thereof. The nozzle tip can be metal, ceramic, glass, polymeric, a composite material, or can include one or more of the above materials. Wherein the nozzle tip is polymeric, the nozzle tip can include acetal polyoxymethylene, polyethylene, polypropylene, a fluoropolymer, or a combination thereof. Exemplary material can include acetal polyoxymethylene in the form of Delrin® from E. I. Dupont de Nemours and Company, Delaware, or a fluoropolymer such as Teflon®, also from E. I. Dupont de Nemours and Company. The nozzle tip, or a portion thereof, can be coated. The coating can be on one or more face edge, along the opening, on the outside of the nozzle tip, or a combination thereof. Multiple coatings can be used, simultaneously in one location, or on different parts of the nozzle tip. Suitable coating materials can increase durability, reduce friction, prevent wear, or provide other desirable mechanical properties to the nozzle tip. For example, to increase wear and reduce friction, fluoropolymers such as Teflon® or acetal resins such as Delrin® can be used. According to certain embodiments, the nozzle tip can be a composite, including more than one material. The nozzle tip can include two or more parts forming the nozzle tip when joined. Each of the parts can be the same or a different material from at least one other part.

The nozzle tip as described herein can be part of a device, such as a skiving device. The exit port of the opening can lead to a reservoir capable of containing material removed from a substrate adjacent the opening at the proximal end of the nozzle tip. The opening, the reservoir, or both can be heated or cooled directly or indirectly by electric heat, steam, heat exchanger, or any other heating mechanism. The heating mechanism can provide temperatures from 0° C. to 100° C. In certain embodiments, higher or lower temperatures can be obtained. The reservoir can be connected to a collector for removed material, such as a waste container.

Material skived by the nozzle tip can be removed from the substrate by gravity; solvent jet, including air or water; or by movement of the skived material through the nozzle tip opening. Movement of skived material through the nozzle tip opening can be encouraged by use of a solvent flowing from the proximal end to the distal end of the opening. The skived material can move through the nozzle tip opening by gravity where the distal end of the opening is lower than the proximal end of the opening. A vacuum can be used alone or in combination with gravity or a solvent to remove the skived material through the opening. The vacuum can be formed by any known means. For example, the vacuum can be generated by an air drawn suction system, for example, a turbine. The vacuum pressure can be controlled manually or automated. The vacuum pressure can range from 0 to 760 mm Hg. The force exerted by the vacuum on a nozzle tip can range from 0 to an absolute value of 50 $N/mm^2$. Methods of controlling vacuum pressure are known in the art, and can include use of a pressure regulator or valve. The vacuum can be connected to the reservoir for collection and disposal of the removed material. According to certain embodiments, the vacuum apparatus, opening, reservoir, or any combination thereof, can be heated by a heating source, for example, electric heat, a water jacket, or a steam jacket, as stated herein. The vacuum apparatus can include a solvent source. One or more solvent can be added to the material to aid removal through the nozzle tip. According to certain embodiments, the solvent can be added at a temperature sufficient to harden, soften, melt, or dissolve the skived material. Suitable solvents can include solvents capable of hardening, softening, diluting, liquefying, or lubricating the removed material. The solvents can include those that have minimal effect on the nozzle tip material. Suitable solvents can include, for example, alcohols, acids, bases, ammonia-based solvents, bleach-based solvents, water, distilled water, organic solvents, inorganic solvents, air, and surfactants.

According to various embodiments, it can be desirable to have more than one nozzle tip capable of skiving material from the substrate simultaneously or in sequence. An assembly can include one or more devices, each device having one nozzle tip as described herein. The nozzle tips in an assembly can be the same or different. The assembly can have the nozzle tips arranged linearly, staggered, or in any desirable pattern. The reservoirs of each device can be joined or separate. If different nozzle tips in the assembly are removing different materials, separate reservoirs can be used. A common vacuum source can be used if a like removal rate is desired in all nozzle tips. Separate vacuum sources can be used where one or more nozzle tips are desired to have a different removal rate from at least one other nozzle tip, or different materials are removed by different nozzle tips. Different vacuum forces on at least two nozzle tips can be achieved by various means, including, for example, use of separate vacuum sources, a metered manifold, adjustments to the nozzle tip/vacuum configuration, or in-line orifice. Each nozzle tip can have a different vacuum force applied from at least one other nozzle tip. Each nozzle tip can be used in conjunction with a different solvent, wherein the solvent can be optimized for the material being removed by that nozzle tip.

The nozzle tip can include an indicia indicating a side of the nozzle tip to face the material to be skived, the operator, or any desired set position. Complimentary indicia can be located on the device or apparatus, for example, on or in an alignment block, manifold, positioning system, or other apparatus contacting the nozzle tip. The indicia can be in any form, for example, a line, color, dot, pictogram, lettering, numbers, or a combination thereof. The indicia can be an alignment means, such as a tab/slot interaction, groove, keyway, or other three-dimensional alignment feature. The indicia can be used to place the nozzle tip in the correct orientation for skiving. If different nozzle tips are used within one apparatus, the indicia can indicate where each nozzle tip should be placed in the apparatus.

Figure 4:
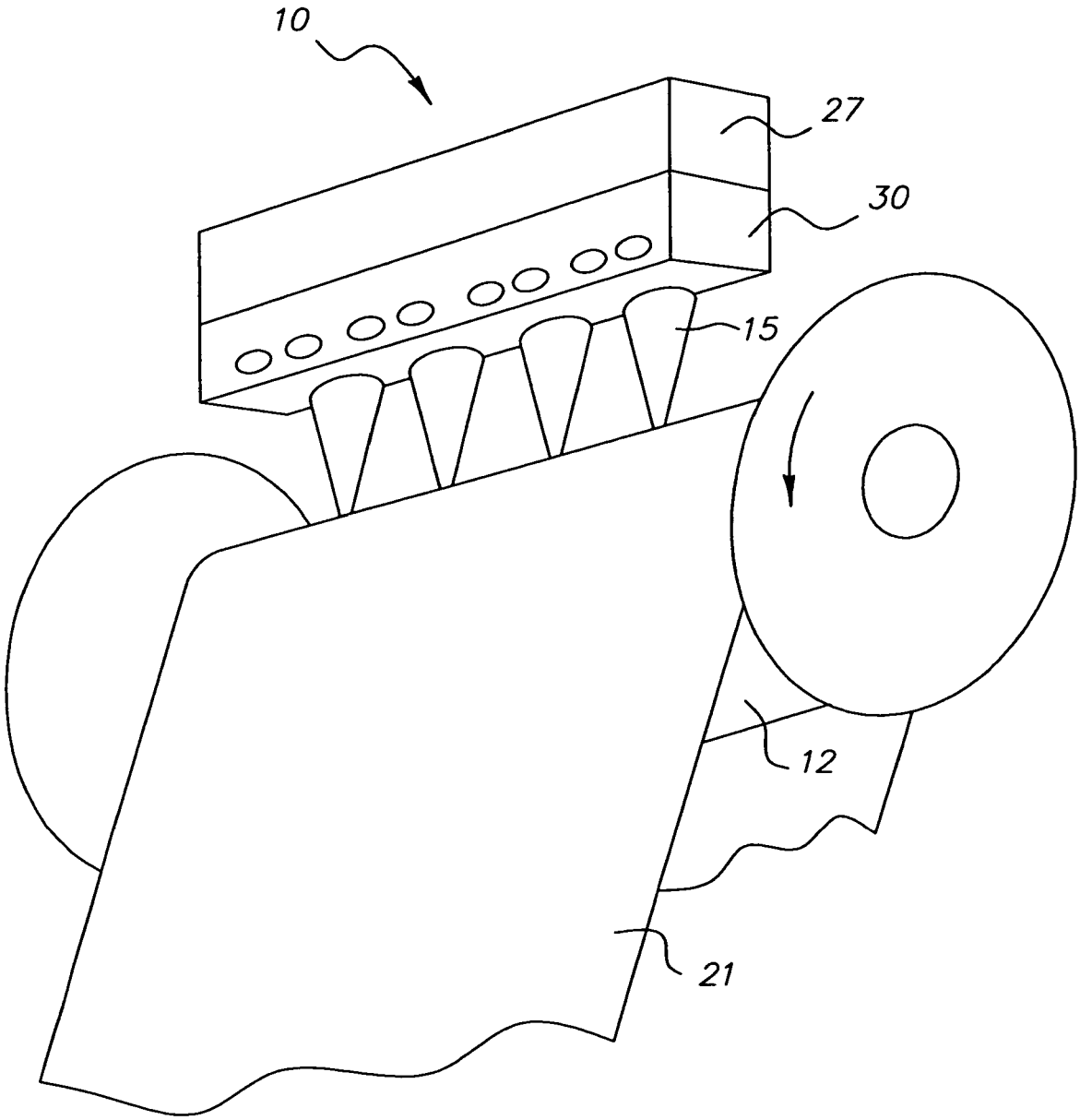
FIG. 4 is a schematic illustration of a skiving assembly.

FIG. 4 shows a skiving assembly 10, wherein nozzle tips 15 can be positioned in or attached to an alignment block 30. The alignment block can maintain alignment of one or more nozzle tips with respect to the substrate, other nozzle tips, the distance of each nozzle tip from a support, or a combination thereof. Use of an alignment block can result in repeatable and precise placement of one or more nozzle tip with respect to the substrate and support. The alignment block can be used with a single skiving device, or can bridge more than one skiving device, such as in a skiving assembly.

The nozzle tips 15 of the assembly 10 can be in contact with substrate 21 all at once, in sequence, or in any combination. The nozzle tips 15 can all be at the same height from the support 12, or at different heights from the support 12.

A manifold 27 can be attached to the nozzle tip 15 or the alignment spacing block 30 to provide a vacuum source for the nozzle tip 15. The alignment block can provide a method of attaching the nozzles tip 15 to the assembly, while ensuring repeatable precise location of the nozzle tip 15 with reference to the substrate. The manifold 27 can act as a channel and/or reservoir for the material removed by the nozzle tip 15. The manifold 27 can optionally include a solvent spray head to inject solvent into the manifold 27 to aid in flow of the removed material through the manifold. The solvents can be as described elsewhere herein. Different solvents can be used in different portions of the assembly, for example, in the nozzle tip opening, the exit port, or the manifold. All or a portion of the manifold can be heated directly or indirectly to aid in material flow through the manifold.

The support 12 can be any material suitable for carrying the substrate 21 past the nozzle tip 15. For example, support 12 can be, but is not limited to, a web, conveyor belt, rotating table, translating table, rotating drum, or roll. The support material can be hard enough to provide support for the substrate, and provide resistance against the nozzle tip without causing damage to the substrate. The support 12 can be, for example, polymeric, metallic, ceramic, glass, fibrous, a composite material, or a combination thereof. According to various embodiments, the support 12 can be at least partially elastic, having some give under the pressure of the nozzle tip 15. For example, the support 12 can be polymeric, such as polyurethane, polyester, phenolic resin, or composite plastics.

The support 12, the assembly 10, or both can be movable relative to one another. The support 12 and nozzle tip 15 can be movable relative to one another. For example, the support, assembly, or both can be moved relative to one another to compensate for side-to-side movement or slippage of the substrate. The support, device, or assembly can be translated to account for movement of the substrate. The support can be designed to minimize movement of the substrate. For example, the support can include a guide, track, groove, or other alignment mechanism to assist in keeping the substrate aligned with respect to the nozzle tips. For example, the support can have a flanged edge to guide the substrate towards the assembly. According to certain embodiments, the support can be a flanged roller.

According to various embodiments, one or more nozzle tip in a device or apparatus can be positioned relative to the edge of the substrate so a material can be removed from a set location. The nozzle tip can be positioned by attachment in the device or apparatus at a set location. For example, the nozzle tip can be attached to a manifold or alignment block at a desired distance from the edge of the substrate. The nozzle tip can be relocatably positioned in the device or apparatus, or permanently positioned. The positioning of the nozzle tip can be from a leading edge of the substrate, a side edge of the substrate, or both. The nozzle tip can be positionable within the device or apparatus, for example, by means of a linear slide actuator, spring, lever, or other adjustable mechanism. The device or apparatus can be positionable relative to the substrate to place a nozzle tip in a desired location. Any of the nozzle tip, device, or apparatus can be positioned manually, automatically, or by a combination thereof. Positioning systems can include physical or optical guides to assist in locating the nozzle tip with respect to the substrate. The device or apparatus can be portable to assist in positioning.

The nozzle tip, device, assembly, or a combination thereof can be moved towards or away from the support to change the height of the nozzle tip in relation to the support. The positioning device can be a linear slide actuator, a linear motor, screw, wedge, pneumatics, hydraulics, or other mechanism capable of planar movement. The positioning device can be used to position one or more nozzle tip to maintain a uniform height with respect to the support. Each nozzle tip can have the same or a different positioning device as at least one other nozzle tip in an apparatus. The positioning device can move the nozzle tip, device, or apparatus about a pivot point, such that the movement of the nozzle tip, device, or apparatus is in an arc with respect to the substrate and support.

A nozzle tip angle positioning mechanism can be used to change the angle at which the nozzle tip intersects the substrate to be skived. The angle can be changed depending upon the glass transition temperature ($T_g$) of the material being skived, the density of the material, the configuration of the skiving nozzle tip, drying or hardening rates of the material, vacuum level, and other factors known to those skilled in the manufacturing arts.

An application angle positioning mechanism can be used to move a device or assembly including one or more nozzle tips around the support where the support is curved, such as a drum or roll. The position desirable for skiving can change depending upon the $T_g$ of the material being skived, the density of the material, the configuration of the skiving nozzle tip, drying or hardening rates of the material, vacuum level, and other factors known to those skilled in the manufacturing arts.

One or more of the above positioning systems can be combined into a single system. The system can be manually controlled, automatically controlled, or a combination thereof. Indicia as described herein can be used on one or more of the support, substrate, nozzle tip, device, or assembly to aid in positioning of the nozzle tip relative to the support and substrate.

A device or assembly including one or more nozzle tips can also include a force mechanism to hold each nozzle tip against the material to be skived. For example, the device or assembly can include a spring, lever, block, weight, other force exerting mechanism, or a combination thereof to position and hold the nozzle tip in relation to the support or substrate. The force mechanism can be gravity. The pressure exerted by the nozzle tip against the substrate along the longitudinal axis of the nozzle tip 15 can be from 0 to 55 Kilopascals. The force mechanism can apply pressure to the nozzle tip to maintain a constant height of the nozzle tip with respect to the support. If more than one nozzle tip is present, uniform pressure can be maintained at each nozzle tip, or each nozzle tip can have a different applied pressure. Each nozzle tip can be made to skive to the same or different depth than each other nozzle tip in the apparatus. The force mechanism can compensate for variability in support thickness, substrate thickness, or a combination thereof. The force mechanism can compensate for non-uniform movement of the support or substrate. The force mechanism can compensate for nozzle tip wear during operation.

According to certain embodiments, a device or assembly can include a solvent dispenser for dispensing one or more solvent onto the material. The solvent dispenser can be a nozzle, opening, slit, spray head, or other known dispensing mechanism. The dispenser can be a separate assembly, or can be located anywhere on the apparatus or device. For example, the dispenser can be part of an alignment block, positioning system, or support for the device or apparatus. The amount of solvent administered can be controlled, for example, by a metering pump, valve, or like mechanism. The mechanism can be operated manually or automated with a timer, computer, automatic controller, other control device, or a combination thereof. The solvent can be capable of softening, removing, or lubricating a desired material from the substrate. Suitable solvents can include, for example, alcohol, acid, base, ammonia-based solvent, bleach-based solvent, water, distilled water, organic solvent, inorganic solvent, air, and surfactant. The solvent dispenser can provide a solvent stream having the same width as the skived area. The solvent dispenser can provide a solvent stream narrower or wider than the skived area as desired. The solvent dispenser can be movable with relation to the substrate, the nozzle tip, or both. With reference to the direction of material movement, the solvent dispenser can be located prior to the nozzle tip, after the nozzle tip, or adjacent the nozzle tip. According to certain embodiments, the solvent dispenser can be located before the nozzle tip a sufficient distance such that the solvent soften, liquefy, or lubricate the material to be skived before it reaches the nozzle tip. The solvent can be delivered at a flow rate sufficient to wet the material without causing movement of the material. A separate solvent dispenser can be associated with one or more nozzle tips, wherein each solvent dispenser can have a different solvent or different solvent width.

One or more additional material removal mechanisms can be used in combination with the skiving device or apparatus. For example, a vacuum tip, doctor blade, skive finger(s), or roller can be used with the skiving device in any configuration. The removal mechanisms can be used to remove material from the substrate, or to clean the substrate prior to or after skiving with the nozzle tip.

The nozzle tip, device, and assembly as described herein allow for accurate removal of a material from a predetermined location on a substrate. Use of the nozzle tip, device, or assembly for a roll-to-roll or continuous process can provide improved accuracy of skiving in the web and cross-web directions, especially as compared to prior batch processes. Use of the device or apparatus can improve the repeatability of the skiving on a substrate because the one or more nozzle tip and the substrate can be held in continuous registration. The percentage of material removed can be greatly increased over the prior art processes, for example, that described in U.S. Pat. No. 6,469,757. In U.S. Pat. No. 6,469,757, the skiving tip must make 10, 20, or more sequential passes over the same location in order to clean the substrate in the desired path, removing only 2-10% of the material with each pass. The nozzle tip described herein can remove the material in one pass. For example, the nozzle tip can remove at least 90% of the material in a single pass, for example, at least 95%, or at least 98% of the material.

The nozzle tip can remove material of various viscosities and various hardnesses. For example, materials that are cross-linked, polymerized, chill-set, or otherwise hardened, as well as low-viscosity materials, can be removed by the nozzle tip in a batch or roll-to-roll process. Nozzle tips and skiving methods known previously in the art are not capable of removing hardened materials in a single pass.

Materials skived with the nozzle tip described herein can have a desirable appearance, for example, a desirable profile, with little or no disturbance of the structure and topography of the unskived portions of the substrate, and no bleeding of the unskived portions of the substrate. For example, little or no plowing of the substrate occurs using the nozzle tip as described herein. The edges of the chasm in the substrate can be substantially smooth and free of unwanted materials, having a standard deviation of width of the chasm of less than 5%, for example, less than 2%, from the width of the nozzle tip.

The nozzle tip and skiving assembly or device as described herein can be used to shape substrates for various applications. Skiving can be one of many steps in substrate preparation. Skiving can be used to form intricate patterns, such as in making intricate materials, including papers, building materials, or displays, and in forming plates for lithography, intaglio, engraving, or other printing processes. Skiving can be used for making precisely controlled cuts in finished substrates, for example, in slicing, separating, forming perforations, or other cutting operations. Skiving can also be used to prepare substrates for further steps by removing unwanted material from precise locations on the substrates. For example, in manufacturing liquid crystal displays, a substrate can be formed with a support, a conductive layer such as indium tin oxide, a liquid crystal layer, and a second conductive material. The second conductive material, or the second conductive material and the liquid crystal layer, can be skived in order to expose the liquid crystal layer or the first conductive material, respectively, to allow an electrically conductive path to the first conductive material to be created. The electrically conductive path is needed to create an electrical field to change the polarity of the liquid crystals, enabling use as a display. The liquid crystal layer can comprise more than one layer of liquid crystals. The liquid crystal material can be nematic, smectic, ferroelectric, cholesteric, or a combination thereof. Other types of imaging elements can be made using the nozzle tips described herein, including, for example, light emitting diodes, organic light emitting diodes, electrophoretic materials, electrochromic materials, reflective print materials, and bichromal materials. The imaging elements can be used in electronic shelf labels, sign displays such as used in stores, signage, viewscreens, or other display applications.

Skiving can be done in the web direction, which is the direction of movement of the substrate, or in a cross-web direction, which is any direction not parallel the direction of movement of the substrate. According to various embodiments, skiving can be done in both a web direction and a cross-web direction simultaneously. Skiving can be controlled to form any desired shape in a substrate, for example, a linear or curved shape. Skiving can be performed in one or more phases of substrate preparation, with or without intermediate steps, such as coating. Other material removal systems can be used in combination with the skiving assembly described herein.

Figure 5:
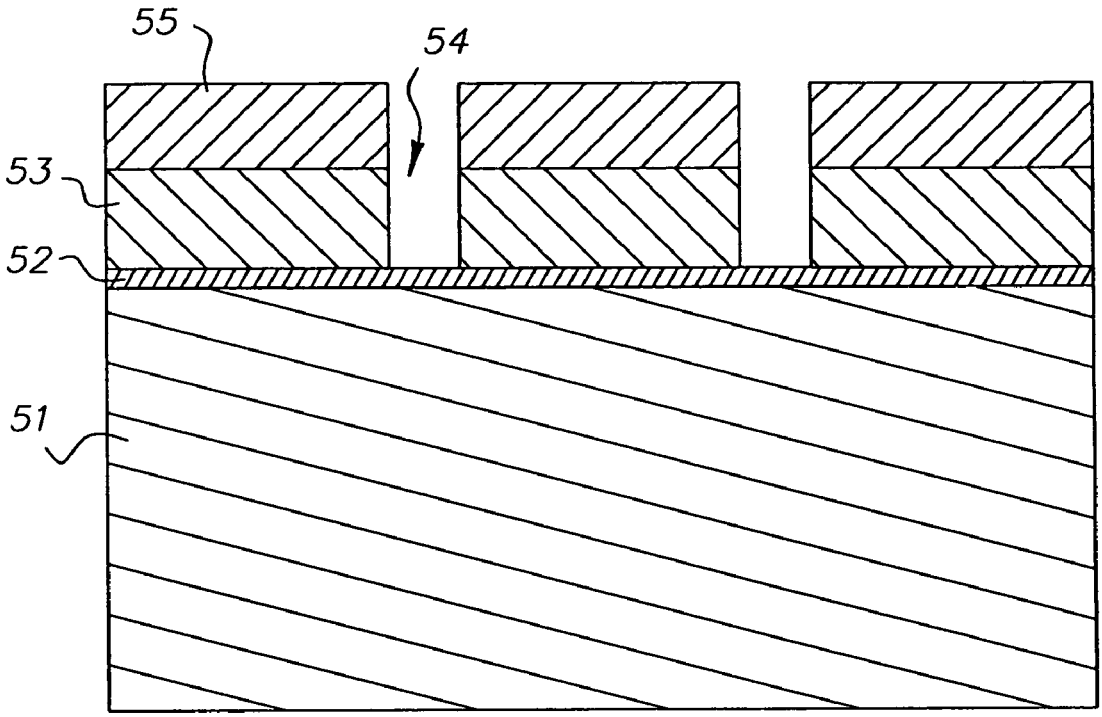
FIG. 5 depicts a substrate with one or more layers selectively removed by a nozzle tip.

In use, the nozzle tip described herein can be used in a device or apparatus in a batch or roll-to-roll manufacturing process. For example, a liquid crystal display can be made using the nozzle tip and according to the methods described herein. As shown in FIG. 5, a support 51 can be formed of glass, or a flexible material, for example, polyethylene terephthalate. The support 51 can be coated with a first conductive layer 52, for example, indium tin oxide. The first conductive layer 52 can be coated with a liquid crystal dispersion 53, for example, an aqueous coating of a liquid crystal emulsion in a binder, such as gelatin. The liquid crystal layer 53 can be chill-set or otherwise hardened. A second conductive layer 55 can be formed over the liquid crystal layer, for example, coating in a layer or a pattern. The nozzle tip as described herein can be used to remove the second conductive layer 55 and the liquid crystal layer 53 in one pass, forming chasms 54 as shown in FIG. 5.

As described herein, a nozzle tip can be made for skiving, wherein the nozzle tip has two faces, improving the precision of the nozzle tip. A device or apparatus including one or more nozzle tips can be positioned relative a substrate to remove at least a portion of the material from the substrate, forming a chasm in the substrate. The chasms can be created in the web or cross-web direction on the substrate, and can form a pattern.

Although the nozzle tip, device, and assembly are described with respect to skiving, one skilled in the coating arts will recognize the benefits of using the nozzle tip, device and assembly for coating on a substrate as well. Suitable rearrangement of the features of the device or apparatus for coating will be apparent to practitioners in the coating arts. Features of the invention as set forth herein are exemplified in the following examples.

EXAMPLES

Figure 6A:
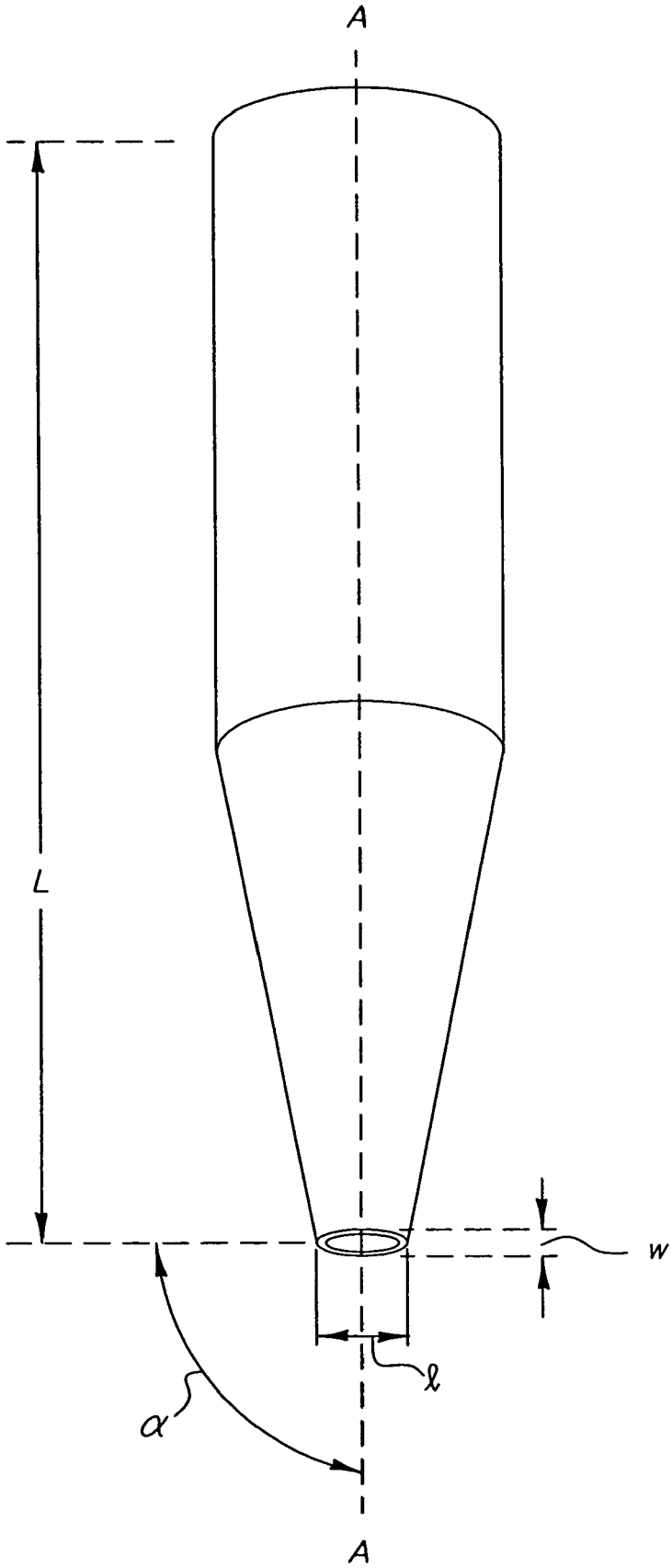
FIG. 6A (PRIOR ART)
FIG. 6A depicts a view of the nozzle skiving tip used in prior art.

A variety of skiving nozzle tips were prepared according to the dimensions and configurations defined in Table 1 below. The following examples screen the various nozzle tip designs to determine optimum nozzle tip design and nozzle tip angle for use in skiving. Comparative nozzle tips C1-C3 are single face nozzle tips, as shown in FIG. 6A. Nozzle tip C1 is the same nozzle tip design exemplified in U.S. Pat. No. 6,469,757. Comparative nozzle tips C2 and C3 are modified version of C1, wherein the angle of the nozzle tip is changed from 90 degrees to less than 90 degrees, as shown in Table 1.

Figure 6B:
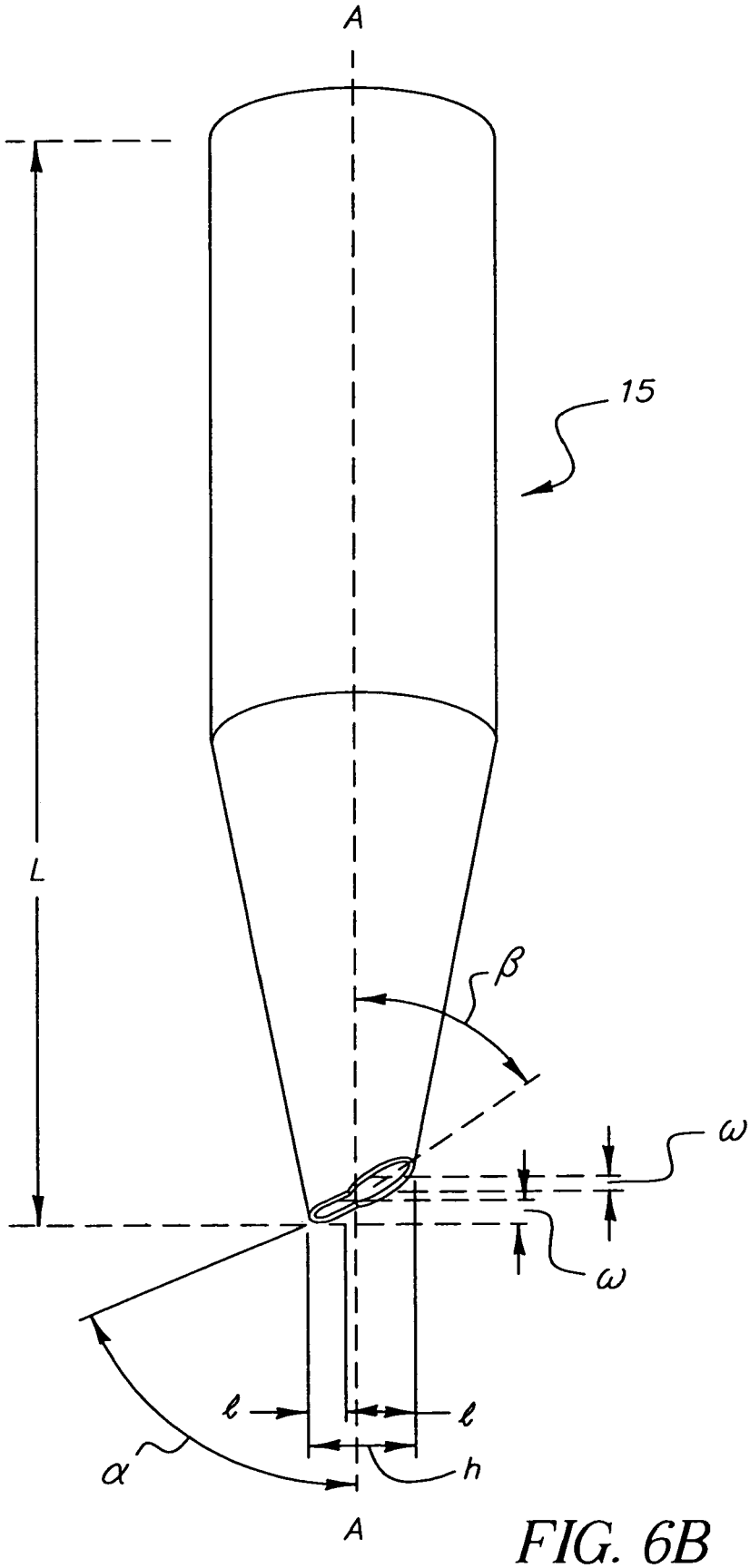
FIG. 6B depicts a nozzle tip configuration of the invention.

All nozzle tips except IT6 were made of polypropylene. IT6 was made of Delrin® from E.I. Dupont de Nemours and Company. The length varies between nozzle tips, and is set forth for each nozzle tip in Table 1. The nozzle tip length is measured from the first face of the nozzle tip to the distal end of the nozzle tip, as shown in FIG. 6A (comparative nozzle tip) and FIG. 6B (inventive nozzle tip) by "L." The first face angle α, and the second face angle β are measured as described previously herein, and are shown in FIGS. 6A and 6B. The width of each face is measured across each face in a direction perpendicular to the direction of web movement, as shown by "w" in FIGS. 6A and 6B. The face length is measured across each face in the direction of web movement, as shown by "l" in FIGS. 6A and 6B. The height of the first face is measured from the surface of the substrate to the outer edge of the first face as "h" in FIGS. 6A and 6B. The height of the second face is 0 because at least one portion of the second face touches the substrate. The total nozzle tip area is the combined area of both faces of the nozzle tip.

TABLE 1

| | | 1rst Face | | | | 2nd Face | | | Total tip |
|---|---|---|---|---|---|---|---|---|---|
| Tip | Length (mm) | Angle | Width (mm) | Length (mm) | Height (mm) | Angle | Width (mm) | Length (mm) | Area ($mm^2$) |
| C1 | 67.31 | n/a | n/a | n/a | 0 | 90° | 1.65 | 1.65 | 2.14 |
| C2 | 69.22 | n/a | n/a | n/a | 0 | 35° | 0.76 | 1.78 | 5.07 |
| C3 | 67.31 | n/a | n/a | n/a | 0 | 45° | 1.27 | 3.30 | 4.20 |
| IT1 | 66.68 | 90° | 1.50 | 0.76 | 0.648 | 45° | 1.78 | 0.76 | 4.62 |
| IT2 | 66.60 | 90° | 1.35 | 0.94 | 0.700 | 40° | 1.35 | 1.02 | 4.06 |
| IT3 | 70.31 | 95° | 1.14 | 0.69 | 0.584 | 45° | 1.55 | 0.69 | 3.30 |
| IT6 | 31.75 | 90° | 1.50 | 0.58 | 0.497 | 45° | 1.52 | 2.49 | 6.46 |

The materials used in the examples are polypropylene obtained from VWR in West Chester, Pa. as a pipette tip; Indium Tin Oxide coated on a polyethylene terephthalate substrate was from Bekaert Specialty Films, LLC, San Diego, Calif.; and carbon black and gelatin, were obtained from Eastman Kodak Company, Rochester, N.Y.

Figure 7A:
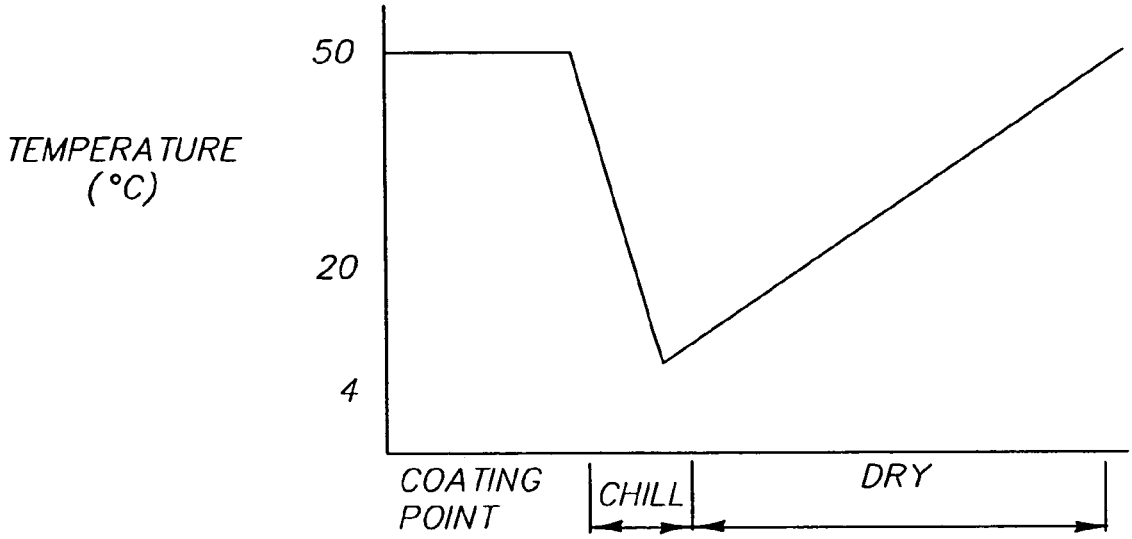
FIG. 7A depicts a coating process timeline with reference to temperature.
Figure 7B:
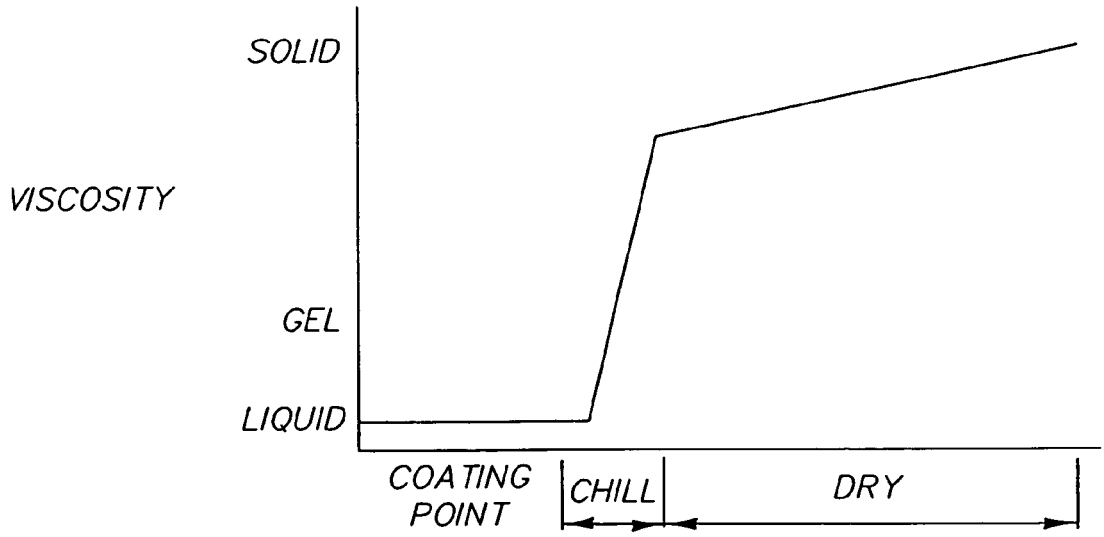
FIG. 7B depicts a coating process timeline with reference to viscosity.
Figure 7C:
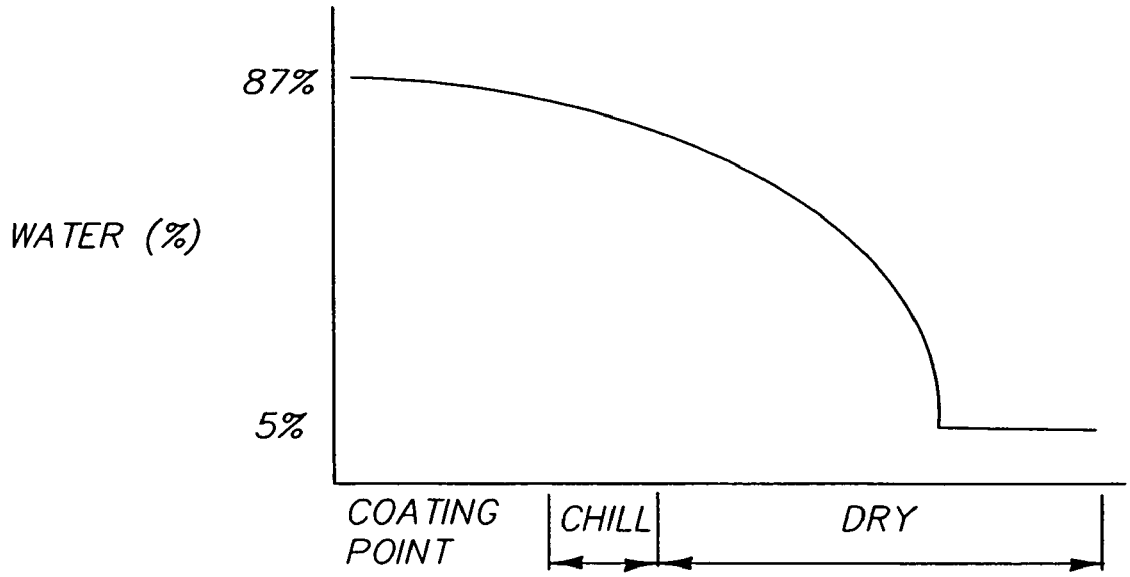
FIG. 7C depicts a coating process timeline with reference to percent solids.

All examples were performed on a roll-to-roll coating machine, wherein a coat pack of gelatin was applied, chill-set, and dried. Skiving was performed in the chill-setting section of the machine. The parameters of the coating process are set forth in FIGS. 7A-7C.

Example 1

Nozzle tips C1, C2, IT1, IT2, and IT3 as shown in Table 1 were evaluated for their effectiveness in skiving. The details and results are shown in Table 2. For this example, a 150 micron (6 mil) thick polyethylene terephthalate substrate having a conductive layer of Indium Tin Oxide (ITO) was coated with two layers of gelatin. The first layer was a 5.0 wt % gelatin solution containing 0.27 wt % carbon black applied at 61.5 $ml/m^2$. The second layer was a 4.17 wt % gelatin solution applied at 10.18 $ml/m^2$. The coated layers were cooled to a temperature less than 37° Celsius in order to chill-set the gelatin. The coated layers had a total depth of about 45 micrometers in the chill-set section of the coating machine. Skiving was conducted with the coating and skiving occurring while the substrate was moved through the respective processes at 12.2 meters per minute. Various vacuum levels were tried with different nozzle tips, as shown in Table 2.

A 1.0 mm wide skive path was desired in the examples, as well as full removal of the gelatin layers without damage to the ITO coating on the substrate. Factors considered in determining skive efficiency included material build-up on the skiving nozzle tip; plowing; incomplete material removal; depth of skive; damage to the ITO layer; and width of skive. For examples 212, 213, and 214, three nozzle tips were tested simultaneously using one shared vacuum source. This is accounted for in the results table by a calculation of the power distributed through each nozzle tip, P/Area, where area is the combined area of all nozzle tips connected to the vacuum source.

Plowing is the unwanted accumulation of skived material on the remaining gelatin, and can be referred to as material build-up. Plowing was rated on a scale of 0-4 as follows:

0=no plowing

1=little material build-up

2=some material build-up

3=significant material build-up

4=little to no material removed

The angle of tip is the angle at which the longitudinal axis of the nozzle tip intersects the substrate.

TABLE 2

| Example | Tip | Angle of Tip | Vacuum (mm Hg) | P/Area (N/mm2) | Skive width (mm) | Plowing | Skive Efficiency |
|---|---|---|---|---|---|---|---|
| C201 | C1 | 90° | 622.3 | −25.00 | 0.76 | 2 | Poor |
| C202 | C1 | 90° | 533.4 | −21.43 | 1.12 | 2 | Poor |
| C203 | C1 | 90° | 406.4 | −16.33 | 1.02 | 3 | Poor |
| C204 | C2 | 90° | 596. | −14.22 | 0.61 | 3 | Poor |
| 205 | IT3 | 45° | 546. | −10.13 | 1.47 | 2 | Acceptable |
| 206 | IT1 | 45° | 596.9 | −11.11 | 1.22 | 0 | Acceptable |
| 207 | IT1 | 45° | 406.4 | −7.57 | 0.51 | 0 | Good |
| 208 | IT1 | 45° | 584.2 | −10.88 | 0.58 | 0 | Acceptable |
| 209 | IT1 | 45° | 457.2 | −8.51 | 0.56 | 0 | Acceptable |
| 210 | IT1 | 45° | 330.2 | −6.15 | 0.58 | 0 | Acceptable |
| 211 | IT1 | 45° | 203.2 | −3.78 | 0.66 | 0 | Acceptable |
| 212a | IT1 | 45° | 127 | −1.10 | 0.64 | 0 | Good |

TABLE 2-continued

| Example | Tip | Angle of Tip | Vacuum (mm Hg) | P/Area (N/mm2) | Skive width (mm) | Plowing | Skive Efficiency |
|---|---|---|---|---|---|---|---|
| 212b | IT2 | 45° | 127 | −1.10 | 1.10 | 0 | Acceptable |
| 212c | IT3 | 45° | 127 | −1.10 | 0.90 | 0 | Good |
| 213a | IT1 | 45° | Unmeasured | −1.10 | 0.53 | 0 | Good |
| 213b | IT2 | 45° | Unmeasured | −1.10 | 0.65 | 0 | Good |
| 213c | IT3 | 45° | Unmeasured | −1.10 | 0.54 | 0 | Good |
| 214a | IT1 | 45° | 152.4 | −1.10 | 0.81 | 0 | Good |
| 214b | IT2 | 45° | 152.4 | −1.10 | 0.97 | 0 | Acceptable |
| 214c | IT3 | 45° | 152.4 | −1.10 | 0.91 | 0 | Good |
| 215 | IT3 | 45° | 152.4 | −3.97 | 0.56 | 0 | Acceptable |

As shown in Table 2, the skiving quality of the comparative nozzle tip C1 (C201-C203) was poor at the maximum level of vacuum and became progressively worse as the vacuum level decreased. Comparative nozzle tip C2 (C204) showed significant plowing at high vacuum. In comparison, the inventive nozzle tips IT1 through IT3 showed acceptable to good results in skiving, even at low vacuum levels.

Further, it was noted during the experiments that the comparative nozzle tips required manual assistance to start or maintain skiving. In contrast, the inventive nozzle tips started skiving without manual intervention or additional force being applied to the nozzle tip or skiving assembly. Additionally, the inventive nozzle tips required significantly lower contact force to dislodge the coated material, and experienced significantly less nozzle tip wear as compared to the comparative examples.

As shown in Table 2, the inventive nozzle tips were capable of creating an acceptable skive with as little as $1/6^{th}$ the force (P/Area) that was required by the comparative nozzle tip C1, as shown by examples 212a, 212c, 213a, 213c, 214a, and 214c.

Example 2

Bi-facial nozzle tip IT6 was manufactured as indicated in Table 1, with an area of 6.46 $mm^2$. All the skiving trials were run with a vacuum pump at the vacuum levels indicated in Table 3 on the substrate as described in Example 1. Each skiving assembly included three identical IT6 nozzle tips connected to a common manifold and vacuum source. All three nozzle tips were at a tip angle of 45 degrees with reference to the substrate. The skiving test was repeated five times at each vacuum level, obtaining consistent results, which are shown in Table 3 below. The desired skive width was 1.5 mm. Improved results as compared to the comparative nozzle tips of Table 2 were obtained, as shown in Table 3.

TABLE 3

| Example | Vacuum (mm Hg) | P/Area (N/mm2) | Skive Width (mm) | Plowing | Skive Efficiency |
|---|---|---|---|---|---|
| 301 | 279.4 | −1.24 | 1.524 | 0 | Good |
| 302 | 203.2 | −0.90 | 1.651 | 0 | Good |
| 303 | 152.4 | −0.68 | 1.6595 | 1 | Good |

Example 3

Preparation

An emulsion of cholesteric liquid crystal oil (BL118 ® from E. M. Merck, Inc. Hawthorne, N.Y., U.S.A.) was produced by combining the cholesteric liquid crystal oil with an aqueous solution containing finely divided silica (LUDOX TM® from E.I. Dupont de Nemours), and a copolymer of adipic acid and 2-(methylamino) ethanol. The emulsion was mixed to form a dispersion of liquid crystals having a volume mean diameter of 10 microns with low polydispersity.

Method 1 (Invention)

An aqueous coating solution was prepared containing 10 weight percent of liquid crystal emulsion prepared above, 5 weight percent gelatin, and about 0.2 weight percent of a coating surfactant. The coating solution was heated to 45° C., which reduced the viscosity of the solution to approximately 8 centipoises. A three percent by weight gelatin cross-linker bisvinylsulfonylmethane was added to the coating solution immediately before coating. A polyethylene terephthalate substrate with 125-micron thickness and 5-inch width having an Indium Tin Oxide conductive layer ("ITO") of 300 ohms per square was continuously coated with the mixed heated solution at 61.5 $cc/m^2$ on a photographic coating machine. The machine speed was set so that the solution temperature was reduced to 10° C. in the chill section of the machine such that the solution viscosity increased from a liquid state to a very high-viscosity gel state. Located in the chill section was a skiving apparatus having three nozzle tips. A first nozzle tip was positioned to remove material located at the center of the substrate, and the two remaining nozzle tips were positioned 2.5 cm on either side of the center nozzle tip. The wet material had a depth of approximately 100 microns. The material, once chill-set, was completely removed to a depth of 100 microns by the nozzle tips to expose the ITO. After passing through the chill section and skiving apparatus, the solution was chill-set hard enough to enable drying by warm air and passage over roller sets in a drying area of the photographic coating equipment. The dried coating had three continuous skives. The target skive width was 3.175 mm.

Method 2 (Comparison)

The material for Method 2 was prepared in the same manner as Method 1, except the skiving apparatus was removed and no skive lines were made. The material was subsequently skived after drying using the method of U.S. Pat. No. 6,469,757 to produce skives in the same relative locations as those produced by Method 1.

Method 3 (Comparison)

The material for Method 3 was prepared in the same manner as in Method 1, except the skiving apparatus was removed and no skive lines were made. Instead of using the gelatin cross-linker bisvinylsulfonylmethane, distilled water was added to the coating solution immediately before coating. The material was subsequently skived after drying using the method of U.S. Pat. No. 6,469,757 to produce skives in the same relative locations as those produced by Methods 1 and 2.

Results are shown in Table 4. Widthwise repeatability is a standard deviation of the location of the skive relative to the edge of the substrate. This is an indication of the variability of the repeatability of the skive location relative to the edge of the substrate. Skive width repeatability is reported as a standard deviation of the skive width over the length of 15 cm. This is an indication of the variability of the lengthwise accuracy of the skive width.

TABLE 4

| | Widthwise Accuracy | Widthwise Repeatability | Skive width Repeatability | Physical Appearance |
|---|---|---|---|---|
| Method 1 | Good | 0.049 | 0.040 | Good |
| Method 2 | Poor | N/A | N/A | Poor |
| Method 3 | Poor | 0.142 | 0.217 | Poor |

Method 1 resulted in a skive with excellent widthwise and skive width accuracy and repeatability, as well as an excellent physical appearance. The comparison methods 2 and 3 exhibited poor widthwise and skive width accuracy and repeatability, as well as a poor physical appearance. Method 2, the method of U.S. Pat. No. 6,469,757, was unable to skive the cross-linked sample. It is noted the inventive method was also used to skive a dried substrate, as prepared for methods 2 and 3, with results similar to those achieved by skiving during chill-set with method 1.

The invention has been described in detail with particular reference to certain embodiments thereof. Variations and modifications can be effected within the spirit and scope of the invention.

PARTS LIST

10 Skiving Assembly
12 Support
15 Nozzle Tip
16 Opening
21 Substrate
23 Material
27 Manifold
30 Alignment block
37 First face
38 Second face
39 Proximal end
40 Distal end
41*a* First face edge
41*b* Second face edge
51 Support
52 First conductive layer
53 Liquid crystal layer
54 Chasm
55 Second conductive layer
α Angle of first face from longitudinal axis
β Angle of second face from longitudinal axis
d Diameter of opening
$h_1$ Height of first face edge from support
$h_2$ Height of second face edge from support
h First face height
L Nozzle tip length
l Nozzle tip face length
w Nozzle tip face width

The invention claimed is:

1. A process for selectively removing material from a substrate comprising at least one layer, the process comprising:

providing the substrate having materials thereon to an assembly comprising at least one nozzle tip, wherein the nozzle tip comprises a proximal end, a distal end, and a longitudinal axis extending from the proximal end to the distal end, the proximal end having an opening defined by a first edge and a second edge, the first edge being at an angle of from about 20 degrees to about 120 degrees relative to the axis, and the second edge being at an angle of from about 15 degrees to about 70 degrees relative to the axis;

contacting the at least one nozzle tip with the substrate such that at least one of the first edge or the second edge of the nozzle tip penetrates the materials on the substrate; and moving the assembly in relation to the substrate to skive at least a portion of the substrate in contact with at least one nozzle tip, the nozzle tip being capable of skiving cross-linked materials on the substrate and removing all desired material in a single pass.

2. The process of claim 1, wherein the substrate is on a support.

3. The process of claim 2, wherein the support is a web, a flanged roller, a translating table, or a combination thereof.

4. The process of claim 1, further comprising vacuuming the skived substrate through the nozzle tip.

5. The process of claim 1, further comprising attaching the at least one nozzle tip to a manifold.

6. The process of claim 1, further comprising roll-to-roll manufacturing.

7. The process of claim 1, wherein the materials on the substrate include cross-linked materials.

8. The process of claim 1, wherein the nozzle tip is contacted with the substrate with a pressure exerted by a spring, lever, or weight acting on the nozzle tip.

9. The process of claim 1, wherein the assembly further comprises a solvent dispenser, and the process further comprises:

providing the substrate to the solvent dispenser; and applying solvent from the solvent dispenser to the substrate.

10. The process of claim 1, wherein the materials on the substrate comprise cholesteric liquid crystal material.

11. The process of claim 9, wherein the solvent is dispensed before contacting the nozzle tip with the substrate.

12. The process of claim 1, wherein the substrate comprises a light modulating material.

13. The process of claim 12, wherein the substrate further comprises a conductive material below the light modulating material.

14. The process of claim 12, wherein the light modulating material is chill-set, hardened, polymerized, or a combination thereof.

15. The process of claim 12, wherein the light modulating material comprises liquid crystals, electrophoretic material, electrochromic material, bichromal materials, or a combination thereof.

16. The process of claim 12, wherein the light modulating material comprises liquid crystals selected from cholesteric, nematic, ferroelectric, and smectic liquid crystals, or a combination thereof.

17. A method of making a display, comprising:

providing a substrate;

providing at least a cholesteric liquid crystal material over the substrate;

providing an assembly comprising at least one nozzle tip, wherein the nozzle tip comprises a proximal end, a distal end, and a longitudinal axis extending from the proximal end to the distal end, the proximal end having an opening defined by a first edge and a second edge;

contacting the at least one nozzle tip with the substrate such that at least one of the first edge or the second edge of the nozzle tip penetrates the cholesteric liquid crystal material on the substrate; and skiving at least a portion of the substrate in contact with the at least one nozzle tip, removing desired cholesteric liquid crystal material in a roll-to-roll manufacturing process.

18. The method of claim 17, wherein the substrate is on a support.

19. The method of claim 17, further comprising vacuuming the skived material through the nozzle tip.

20. The method claim 17, wherein the step of skiving removes all the desired materials on the substrate in a single pass.

21. The method of claim 17, further comprising providing cross-linked materials on the substrate.

22. The process of claim 17, further comprising providing the substrate to a solvent dispenser; and applying solvent from the solvent dispenser to the substrate.

23. The method of claim 17, further comprising providing a light modulating material on the substrate.

24. The method of claim 23, further comprising providing a conductive material below the light modulating material.

25. The method of claim 24, wherein the light modulating material comprises liquid crystals, electrophoretic material, electrochromic material, bichromal materials, or a combination thereof.

* * * * *